US005361064A

United States Patent [19]

Hamer et al.

[11] Patent Number: 5,361,064

[45] Date of Patent: Nov. 1, 1994

[54] VEHICLE DETECTOR WITH POWER MAIN NOISE COMPENSATION

[75] Inventors: Steven M. Hamer, Willernie; Earl B. Hoekman, Roseville, both of Minn.

[73] Assignee: Minnesota Mining and Manufacturing Company, St. Paul, Minn.

[21] Appl. No.: 716,299

[22] Filed: Jun. 17, 1991

[51] Int. Cl.[5] ..... G08G 1/01

[52] U.S. Cl. ..... 340/939; 340/941

[58] Field of Search ..... 340/939, 933, 941, 938; 324/207.26, 207.12, 222, 224

[56] References Cited

U.S. PATENT DOCUMENTS

| | | | |
|---|---|---|---|
| 3,397,364 | 8/1968 | Crandall | 340/939 |
| 3,436,649 | 4/1969 | Takechi et al. | 340/941 |
| 3,943,339 | 3/1976 | Koerner et al. | 377/9 |
| 3,949,162 | 4/1976 | Malueg . | |
| 3,989,932 | 11/1976 | Koerner | 340/938 |
| 4,276,539 | 6/1981 | Eshraghian et al. | 340/939 |
| 4,459,561 | 7/1984 | Clark et al. | 331/65 |
| 4,668,951 | 5/1987 | Duley et al. | 340/941 |
| 4,862,162 | 8/1989 | Duley | 340/938 |
| 4,873,494 | 10/1989 | Jefferis | 331/65 |
| 5,012,131 | 4/1991 | Maben et al. . | |

*Primary Examiner*—Curtis Kuntz
*Assistant Examiner*—Ping W. Lee
*Attorney, Agent, or Firm*—Gary L. Griswold; Walter N. Kirn; Kari H. Bartingale

[57] ABSTRACT

A vehicle detector includes an inductive sensor which is driven by an oscillator to produce an oscillator signal having a frequency which is a function of inductance of the inductive sensor. Presence of a vehicle is detected when measured frequency of the oscillator signal changes by more than a threshold value. The effects of magnetic flux produced by adjacent power lines are compensated by measuring the frequency of the oscillator signal during a plurality of sample periods and characterizing the fluctuation of the measured frequency as a function of phase of a power main signal. During a normal measurement period, the frequency of the oscillator signal is measured, and the phase of the power main signal during the measurement period is determined. An output signal is produced based upon the measured frequency, the phase, and the known fluctuation of measured frequency as a function of phase of the power main signal.

20 Claims, 2 Drawing Sheets

VEHICLE DETECTOR WITH POWER MAIN NOISE COMPENSATION

BACKGROUND OF THE INVENTION

The present invention relates to vehicle detectors which detect the passage or presence of a vehicle over a defined area of a road way. In particular, the present invention relates to a vehicle detector with compensation for periodic noise such as noise produced by power lines near an inductive sensor.

Inductive sensors are used for a wide variety of detection systems. For example, inductive sensors are used in systems which detect the presence of conductive or ferromagnetic articles within a specified area. Vehicle detectors are a common type of detection system in which inductive sensors are used.

Vehicle detectors are used in traffic control systems to provide input data required by a controller to control signal lights. Vehicle detectors are connected to one or more inductive sensors and operate on the principle of an inductance change caused by the movement of a vehicle in the vicinity of the inductive sensor. The inductive sensor can take a number of different forms, but commonly is a wire loop which is buried in the roadway and which acts as an inductor.

The vehicle detector generally includes circuitry which operates in conjunction with the inductive sensor to measure changes in inductance and to provide output signals as a function of those inductance changes. The vehicle detector includes an oscillator circuit which produces an oscillator output signal having a frequency which is dependent on sensor inductance. The sensor inductance is in turn dependent on whether the inductive sensor is loaded by the presence of a vehicle. The sensor is driven as a part of a resonant circuit of the oscillator. The vehicle detector measures changes in inductance of the inductive sensor by monitoring the frequency of the oscillator output signal.

Examples of vehicle detectors are shown, for example, in U.S. Pat. No. 3,943,339 (Koerner et al.) and in U.S. Pat. No. 3,989,932 (Koerner).

If the inductive sensor is located near electric power distribution lines, magnetic flux from the power lines can introduce a periodic fluctuation in the frequency of the oscillator signal which constitutes noise. This fluctuation, which is at the power main frequency (for example 60 Hz) manifests itself as a variation in the value of the measured frequency when no other stimulus is applied to the vehicle detector. If this condition occurs, and depending on the phase of the mains line at which the measurement is taken, the variation may be large enough to cause an apparent reduction in sensitivity or the vehicle detector may continuously register the presence of a vehicle, even when a vehicle is not present.

SUMMARY OF THE INVENTION

The detector of the present invention detects the change of inductance of an inductive sensor which is driven by an oscillator to produce an oscillator signal having a frequency which is a function of the inductance of the sensor. The effects of periodic noise such as magnetic flux from nearby main power lines are compensated. Fluctuation of the frequency of the oscillator signal caused by the periodic noise is characterized during an initialization phase of operation. During a normal measurement phase of operation, the measurement of oscillator frequency is compensated for periodic noise based upon the prior noise characterization.

In a preferred embodiment of the present invention, the frequency of the oscillator signal is measured during a plurality of sample periods to produce sample values. From these sample values, the fluctuation of the measured frequency of the oscillator signal as a function of phase of a power main signal is characterized.

During normal operation of the vehicle detector, frequency of the oscillator signal is measured during a frame segment, and the phase of the power main signal is determined. The output signal is based upon the measured frequency, the phase, and the characterization of the relationship between measured frequency and phase of the power main signal.

In preferred embodiments of the present invention, the measured frequency is used to produce a measurement value which is a function of the frequency of the oscillator signal. The measurement value (or a reference value) is adjusted by a compensation value which is a function of phase of the power main signal when frequency was measured. The output signal is provided based upon a comparison of the measurement value and the reference value. If the measurement value exceeds the reference value by a predetermined threshold, the output signal indicates that a vehicle has been detected.

DETAILED DESCRIPTION OF THE PREFERRED EMBODIMENTS

Figure 1:
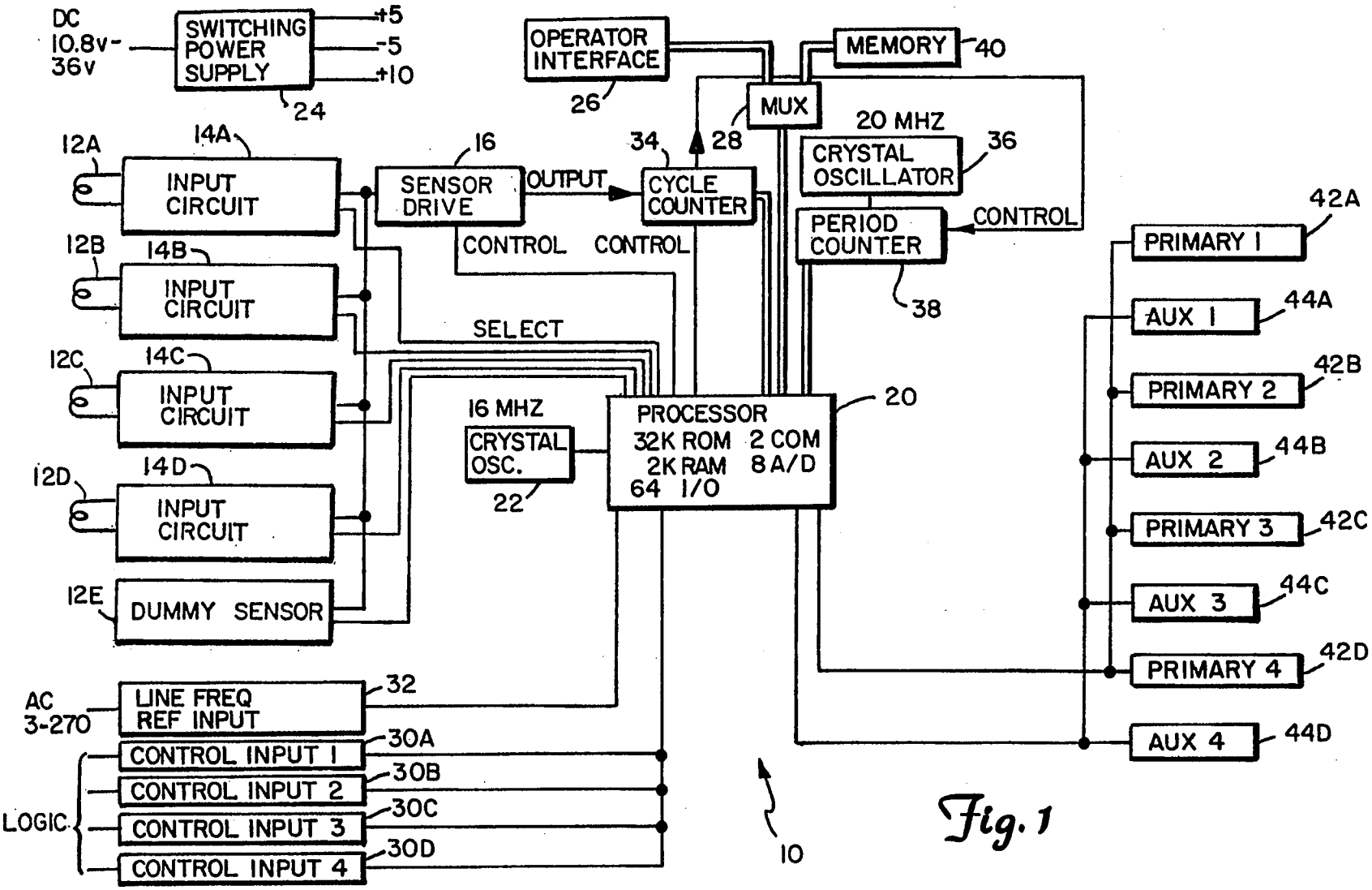
FIG. 1 is a block diagram of a vehicle detector which makes use of the noise compensation feature of the present invention.

Vehicle detector 10 shown in FIG. 1 is a four channel system which monitors the inductance of inductive sensors 12A, 12B, 12C and 12D. Each inductive sensor 12A–12D is connected to an input circuit 14A–14D, respectively. Sensor drive oscillator 16 is selectively connected through input circuits 14A–14D to one of the inductive sensors 12A–12D to provide a drive current to one of the inductive sensors 12A–12D. The particular inductive sensor 12A–12D which is connected to oscillator 16 is based upon which input circuit 14A–14D receives a sensor select signal from digital processor 20. Sensor drive oscillator 16 produces an oscillator signal having a frequency which is a function of the inductance of the inductive sensors 12A–12D to which it is connected.

Also shown in FIG. 1, dummy sensor 12E is provided and is connected to sensor drive oscillator 16 in response to a select signal from digital processor 20. Dummy sensor 12E has an inductance which is unaffected by vehicles, and therefore provides a basis for adjustment or correction of the values measured by inductive sensors 12A–12D.

The overall operation of vehicle detector 10 is controlled by digital processor 20. Crystal oscillator 22 provides a high frequency clock signal for operation of digital processor 20. Power supply 24 provides the necessary voltage levels for operation of the digital and analog circuitry within the vehicle detector 10.

Digital processor 20 receives inputs from operator interface 26 (through multiplexer 28), and receives control inputs from control input circuits 30A–30D. In a preferred embodiment, control input circuits 30A–30D receive logic signals, and convert those logic signals into input signals for processor 20.

Processor 20 also receives a line frequency reference input signal from line frequency reference input circuit 32. This input signal aids processor 20 in compensating signals from inductive sensors 12A–12D for inductance fluctuations caused by nearby power lines.

Cycle counter 34, crystal oscillator 36, period counter 38, and processor 20 form detector circuitry for detecting the frequency of the oscillator signal. Counters 34 and 38 may be discrete counters (as illustrated in FIG. 1) or may be fully or partially incorporated into processor 20.

In a preferred embodiment of the present invention, digital processor 20 includes on-board read only memory (ROM) and random access memory (RAM) storage. In addition, non-volatile memory 40 stores additional data such as operator selected settings which are accessible to processor 20 through multiplexer 28.

Vehicle detector 10 has four output channels, one for each of the four sensors 12A–12D. The first output channel, which is associated with inductive sensor 12A, includes primary output circuit 42A and auxiliary output circuit 44A. Similarly, primary output circuit 42B and auxiliary output circuit 44B are associated with inductive sensor 12B and form the second output channel. The third output channel includes primary output circuit 42C and auxiliary output circuit 44C, which are associated with inductive sensor 12C. The fourth channel includes primary output circuit 42D and auxiliary output circuit 44D, which are associated with inductive sensor 12D.

Processor 20 controls the operation of primary output circuits 42A–42D, and also controls the operation of auxiliary output circuits 44A–44D. The primary output circuits 42A–42D provide an output which is conductive even when vehicle detector 10 has a power failure. The auxiliary output circuits 44A–44D, on the other hand, have outputs which are non-conductive when power to vehicle detector 10 is off.

In operation, processor 20 provides sensor select signals to input circuits 14A–14D to connect sensor drive oscillator 16 to inductive sensors 12A–12D in a time multiplexed fashion. Similarly, a sensor select signal to dummy sensor 12E causes it to be connected to sensor drive oscillator 16. Processor 20 also provides a control input to sensor drive oscillator 16 to select alternate capacitance values used to resonate with the inductive sensor 12A–12D or dummy sensor 12E. When processor 20 selects one of the input circuits 14A–14D or dummy sensor 12E, it also enables cycle counter 34. As sensor drive oscillator 16 is connected to an inductive load (e.g., input circuit 14A and sensor 12A) it begins to oscillate. The oscillator signal is supplied to cycle counter 34, which counts oscillator cycles. After a brief stabilization period for the oscillator signal to stabilize, processor 20 enables period counter 38, which counts in response to a very high frequency (e.g., 20 MHz) signal from crystal oscillator 36.

When cycle counter 34 reaches the predetermined number (Nseg) of oscillator cycles after oscillator stabilization, it provides a control signal to period counter 38, which causes counter 38 to stop counting. The final count contained in period counter 38 is a function of the frequency of the oscillator signal, and therefore the inductance of inductive sensor 12A.

In a preferred embodiment of the present invention, each measurement period (which is defined by a predetermined number oscillator cycles) constitutes a "frame segment" of a larger "measurement frame". Each time a frame segment is completed, the final count from period counter 38 is combined with a number which is derived from the final counts produced during earlier frame segments to produce a measurement value. This measurement value is a function of the frequency of the oscillator output signal during the just-completed frame segment, as well as frequency measured during earlier frame segments.

The measurement value is then compared to a reference value. If the measurement value exceeds the reference value by greater than a threshold value, this indicates that a vehicle is present, and processor 20 provides the appropriate output signal to the appropriate primary and auxiliary output circuit.

If there are power lines near one of the inductive sensors 12A–12D, the magnetic flux produced by the current flowing through the power line will affect the oscillator frequency. Because the measurement period of the frame segment in making a single measurement is usually much shorter than the period of the main power signal, the final count contained in period counter 38 will differ depending upon when the measurement was taken during the cycle of the main power signal. The present invention compensates for the power line induced noise by characterizing the change in frequency measured as a function of the phase of a main power signal, and then using that information to adjust the measurement value (or the reference value) as a function of the phase of the main power signal when the frame segment measurement was made.

During an initialization period, digital processor 20 causes a series of measurement samples to be taken on a single inductive sensor. In other words, during the initialization period, oscillator 16 will be connected first to inductive sensor 12A and a predetermined number of sample frame segments will be performed at different phases of the line frequency. In one preferred embodiment of the present invention, a total of eight consecutive samples will be made with a single inductive sensor before the next inductive sensor is connected to sensor drive oscillator 16 and the initialization process is repeated.

The result of the eight consecutive sample frame segments will be eight sample values representing the ending count from period counter 38 at the end of each of the eight sample frame segments. If there is line frequency noise affecting the loop which is connected to oscillator 16, the eight sample values will vary in a pattern which is usually, but not always, sinusoidal.

Line frequency reference input circuit 32 provides a logic signal to processor 20 which indicates the positive-going zero crossing of the power main signal which is supplied to circuit 32. Because the line frequency is known by measuring the time period between adjacent zero crossings of the same polarity, it is possible to determine the phase of the power main signal simply by measuring time after a detected positive-going zero crossing. Processor 20 uses an internal counter, which counts clock pulses from oscillator 22, to provide a measurement of time following a positive-going zero crossing indicated by a logic signal from line frequency reference input circuit 32.

Processor 20 records the time at which each sample frame segment begins and ends. Using the beginning and ending times, processor 20 calculates a mid-point time for each sample frame segment.

Processor 20 then determines from among the eight samples the maximum count Cntmax (which corresponds to the lowest frequency measured) and the minimum count Cntmin (which represents the highest frequency measured).

If there is no moving vehicle present in the initialization, the maximum and minimum sample value counts should be 180° apart in the line frequency noise waveform even if it is not sinusoidal. If a moving vehicle is present, the phase relationship between the maximum and minimum counts will typically not be 180° apart. Processor 20 checks the phase relationship of the maximum and minimum counts by comparing the difference between the time of the maximum count and the time of the minimum count and comparing that value to one half of the total time from one positive-going zero crossing to the next.

$$|Tcntmax - Tcntmin| \approx Tline/2 \qquad \text{Equation 1}$$

where

Tcntmax = time from zero crossing to Cntmax

Tcntmin = time from zero crossing to Cntmin

Tline = time from zero crossing to zero crossing

If Equation 1 is satisfied, processor 20 assumes that the inductive sensor was clear (i.e. no moving vehicle present). If Equation 1 is not satisfied, this indicates that a moving vehicle is present and initialization must be performed again after the vehicle has left the inductive sensor.

The initialization process is performed for each inductive sensor 12A–12D. Once the initialization process has been completed, vehicle detector 10 enters a normal measurement mode, in which each inductive sensor 12A–12D is connected to sensor drive oscillator 16 in a time-multiplexed, sequential fashion. Each inductive sensor 12A–12D is connected in turn to sensor drive oscillator 16 for a measurement frame segment which represents a predetermined number of cycles of the oscillator signal. During the normal operation, line frequency reference input circuit 32 provides a logic signal to processor 20 which indicates each positive-going zero crossing of the power main signal. The beginning and ending times of each measurement frame segment relative to the most recent positive-going zero crossing is measured by processor 20. From that information, processor 20 derives a center time for each measurement frame segment.

Based upon the count in period counter 38 at the end of the measurement frame segment, processor 20 calculates a measurement value which it compares to a reference value. If the measurement value exceeds the reference value by a predetermined threshold value, processor 20 determines that a vehicle is present, and provides the appropriate output signals to the particular primary and auxiliary output circuits corresponding to the particular inductive sensor that was being interrogated.

Line frequency noise is compensated by adjusting the measurement value as a function of phase of the power main signal at the time the measurement frame segment occurred. This compensation is done by subtracting a compensation value from the count for the just-completed measurement frame segment.

The compensation value (Comp) depends upon the time at which the measurement frame segment took place ($T_{meas}$) and the amplitude of the line frequency noise. For sinusoidal noise, amplitude is half the difference between the maximum count Cntmax and the minimum count Cntmin during the initiation period.

$$Comp = (\sin(\omega t_{meas}))(Cntmax - Cntmin)/2 \qquad \text{Equation 2}$$

When noise is asymmetric, the compensation values must be stored as a set of values with each value related to the phase of the line at which it was measured. In this case, each value can be regarded as a reference value to which the measurement value may be compared. The particular reference value to which the measurement value is compared will depend on the average phase of the line at the time when the measurement value was measured.

Once the variation in the measured frequency as a function of phase of the power main signal has been performed during initialization, that characterization can be used for many measurement frame segments before updating is required. This assumes that there are no significant fluctuations in power levels. Updating of the line frequency noise compensation should be performed frequently enough that inaccuracies do not occur, while not being used so frequently that it significantly increases overhead of the system compared to time being used for measurement. For example, the compensation value for a particular phase may be updated on a continuous basis by keeping a running average of samples of the same phase, each taken when the sensor is not affected by a vehicle.

The compensation of line frequency noise is also based upon the assumption that any line frequency noise will maintain a constant phase relationship to the power main signal which is supplied to the input of line frequency reference input circuit 32. As long as any power lines near the inductive sensors 12A–12D are connected to the same power grid as the power main signal supplied to line frequency reference input circuit 32, the assumption of a constant phase relationship should be valid.

In this particular embodiment, the compensation value is subtracted from the measurement value (or from the count for the frame segment). Alternatively, the compensation value could be added to the reference value or could be subtracted from the difference between the measurement and reference values. Also, the compensation value may be set to represent the reference value for measurements taken at any phase of the mains signal. Similarly, although eight sample values are specifically described, any number of samples which are adequate to characterize the fluctuation of measured frequency with phase of the power main signal can be used.

Figure 2:
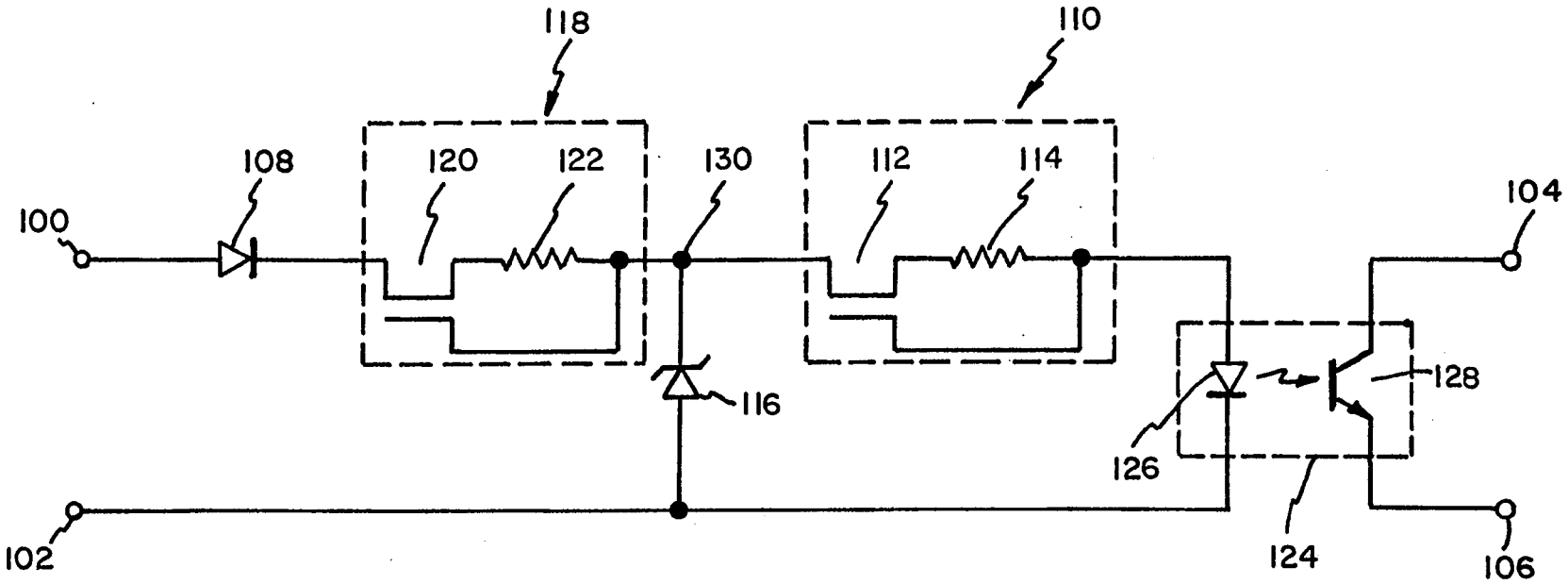
FIG. 2 is an electrical schematic diagram of a preferred embodiment of a line frequency reference input circuit for use in the vehicle detector of FIG. 1.

FIG. 2 shows a preferred embodiment of a line frequency reference input circuit 32. The circuit shown in FIG. 2 is capable of operating with alternating current (AC) power main signals which vary from 3 volts AC to 270 volts AC. The need for this very wide operating range arises because the power main signal available in the field for connection to circuit 32 can vary significantly depending upon whether the power main signal is directly from power lines, or has been stepped down by a transformer. In addition, the circuit of FIG. 2 permits operation at either U.S. or European line voltages and frequencies.

Line frequency reference input circuit 32 of FIG. 2 includes a pair of input terminals 100 and 102, a pair of output terminals 104 and 106, diode 108, first current regulator 110 (formed by depletion mode FET 112 and resistor 114) voltage limiter 116 (which is a transient suppression semiconductor breakdown device), second current regulator 118 (formed by depletion mode FET 120 and resistor 122), and a current sensitive switch in the form of opto-isolator 124 (formed by light emitting diode (LED) 126 and phototransistor 128).

Input diode 108 is connected to input terminal 100. It half-wave rectifies the power main signal which is applied between terminals 100 and 102.

First current regulator 110 permits current through LED 126 to rise up to a first current limit level of one milliamp. LED 126 is capable of turning on with one milliamp of drive current. Once the voltage at terminal 100 has risen with respect to the voltage at terminal 102 so that diode 108 turns on, current regulators 110 and 118 will initially permit up to one milliamp to flow between terminals 100 and 102 (since voltage limiter 116 is off and the only conducting current path is through first current regulator 110).

As soon as the voltage between terminals 100 and 102 has risen to a level where diode 108 and LED 126 turn on, light from LED 126 causes the photo-transistor 128 to turn on. This pulls output terminal 104 down toward the potential of terminal 106, so that the output logic signal changes from a first to a second state. This logic transition indicates that a positive-going zero crossing of the power main signal has occurred.

As the voltage at input terminal 100 continues to rise with respect to terminal 102, the voltage between source and drain of FET 112 rises, and thus the voltage at node 130 rises until the breakdown voltage of voltage limiter 116 is reached. At that point, second current regulator 118 begins to regulate the current up to a maximum of 2 milliamps. The voltage drop across second current regulator 118 increases until the power main input signal reaches its positive peak voltage. Voltage limiter 116 is capable of drawing at least 1 milliamp at its breakdown voltage, and therefore the current drawn through second current regulator 118 will be split between voltage limiter 116 and first current regulator 110.

LED 126 will remain on, and photo-transistor 128 will remain on, until the voltage between terminals 100 and 102 drops to a level at which current to LED 126 drops below a threshold value (less than one milliamp) and LED 126 turns off. This will be slightly before the negative going zero crossing of the power main signal.

As the power main signal continues through its negative half cycle, LED 126 and photo-transistor 128 remain off. At the next positive-going zero crossing, LED 126 will again turn on as soon as the voltage at terminal 100 is sufficiently positive with respect to terminal 102 to turn on diode 108 as well as LED 126.

The line frequency input circuit of FIG. 2 can be used with a very wide range of input voltages (from about 3 to 270 volts AC). In addition, because of the current limiting operation of first and second current regulators 110 and 118 in conjunction with voltage limiter 116, the total current draw of circuit 32 is very low (typically two milliamps). Thus the power consumption is very low, and circuit 32 does not contribute excess heat which could affect other components of vehicle detector 10.

In a preferred embodiment of the present invention, the following components were used:

TABLE I

| | |
|---|---|
| Diode 108 | IN4007 |
| FET 112 | ND202OL |
| Resistor 114 | 1800 ohms |
| Voltage limiter 116 | SMBJ170A (189 volt breakdown) |
| FET 120 | ND202OL |
| Resistor 122 | 820 ohms |
| Opto-Isolator 124 | IL217 |

Although the present invention has been described with reference to preferred embodiments, workers skilled in the art will recognize that changes may be made in form and detail without departing from the spirit and scope of the invention. For example, although the preferred embodiment described senses each positive-going zero crossing of the power main signal, other embodiments are possible in which zero crossings are sensed less frequently, provided the frequency of the power main signal is relatively stable. Similarly, the power main signal and its phase may be sensed and determined indirectly rather than through a direct connection to power lines.

What is claimed is:

1. A method of detecting the presence of an object with an inductive sensor included in an oscillator circuit in which the inductive sensor is varied by the presence of the object, and in which variations in the inductance in turn produce an oscillator signal having a variable frequency which is a function of variations in the inductance of the inductive sensor, the method comprising the steps of:

measuring, in the presence of periodic noise, the frequency of the oscillator signal during an initialization period over a plurality of sample periods to produce a plurality of sample values;

characterizing fluctuations of the frequency of the oscillator signal induced by the periodic noise based upon the sample values to produce a time varying compensation signal;

measuring the frequency of the oscillator signal during a measurement period; and providing an output indicative of the presence of a said object, based upon the frequency measured during the measurement period and the time varying compensation signal.

2. The method of claim 1 wherein the time varying compensation signal is a function of phase of a power main signal, and wherein the method further includes the step of:

determining the phase of the power main signal during the measurement period.

3. The method of claim 2 wherein the measurement period has a time duration which is less than one cycle of the power main signal.

4. The method of claim 2 wherein the step of determining the phase comprises:

sensing a zero crossing of the power main signal; and determining a time from the zero crossing for each measurement period.

5. The method of claim 4 wherein the step of providing an output signal comprises:

producing a measurement value based upon the frequency measured during the measurement period;

producing a compensation value based upon the phase and the time varying compensation signal;

producing a reference value;

determining a difference between the measurement value and the reference value, with a correction by the compensation value; and providing the output signal as a function of the difference.

6. The method of claim 5 comprising providing the output signal indicating the presence of the object if the difference exceeds a threshold value.

7. The method of claim 1 wherein the step of characterizing a periodic fluctuation includes:

determining a maximum sample value and a minimum sample value from among the sample values.

8. The method of claim 7 wherein the step of characterizing fluctuations further includes:

deriving an amplitude of the periodic fluctuation based upon the maximum and minimum sample values.

9. The method of claim 7 wherein the step of characterizing fluctuations further includes:

determining a difference in phase of a power main signal when the maximum and minimum sample values were measured; and rejecting the sample values if the difference in phase is not approximately 180°.

10. The method of claim 1 wherein the step of measuring frequency during a measurement period comprises:

counting a predetermined number of oscillator signal cycles to define the measurement period; and measuring a time duration of the measurement period.

11. The method of claim 1 wherein the step of characterizing fluctuations is further based on a set of reference values corresponding to different phases of a power main signal.

12. The method of claim 1 wherein the step of providing an output signal includes: comparing a measurement value representative of the frequency measured during the measurement period with one of the plurality of sample values depending on the phase of the periodic noise signal; and providing the output signal as a function of the comparing.

13. A method of detecting presence of an object with an inductive sensor driven by an oscillator to produce an oscillator signal having a frequency which is a function of inductance of the inductive sensor, the method comprising the steps of:

determining the phase of a power main signal;

measuring frequency of the oscillator signal during a measurement period having a duration which is less than a period of one cycle of the power main signal;

interrelating the phase and the frequency measured to compensate for periodic changes in inductance of the inductive sensor caused by the power main signal; and producing an output signal, based upon the frequency measured as interrelated to the phase, which indicates whether the object is present.

14. Apparatus for detecting a change in inductance of an inductive sensor whose inductance can be changed by an external magnetic field, the apparatus comprising:

an oscillator circuit connected to the inductive sensor for producing an oscillator signal having a frequency which is a function of inductance of the inductive sensor;

means for providing a measurement value which is a function of the frequency of the oscillator signal during a measurement period;

means for sampling the phase of a power main signal; and means for providing an output signal as a function of the measurement value and phase of said power main signal during the measurement period, which output signal is indicative of said change in inductance.

15. The apparatus of claim 14 and further comprising:

means for providing a compensation value which is a function of the phase of the power main signal during the measurement period, wherein the output signal is a function of the measurement value and the compensation value.

16. The apparatus of claim 15 wherein the means for providing a compensation value comprises:

means for sensing a zero crossing of the power main signal;

means for determining the occurrence time of the measurement period with respect to the zero crossing; and means for supplying the compensation value as a function of the time of occurrence of the measurement period and previously measured measurement values.

17. The apparatus of claim 16 wherein the means for providing a compensation value further comprises:

means for providing an amplitude value representative of amplitude of a sinusoidal variation of the measurement value as a function of phase of the power main signal; and wherein the means for supplying the compensation value provides the compensation value as a function of the time of the measurement period and the amplitude value.

18. The apparatus of claim 15 wherein the means for providing a compensation value includes:

means for causing a plurality of measurement values to be produced which represent measured frequency of the oscillator signal during a series of measurement periods; and means for deriving the compensation value from the measurement values.

19. The apparatus of claim 14 wherein the measurement period has a time duration which is less than one cycle of the power main signal.

20. Apparatus for detecting presence of an object with an inductive sensor, the apparatus comprising:

an oscillator for driving the inductive sensor to produce an oscillator signal having a frequency which is a function of inductance of the inductive sensor;

means for measuring the frequency of the oscillator signal;

means for characterizing a periodic fluctuation in measured frequency of the oscillator signal caused by noise which affects the inductive sensor to produce a time varying compensation signal;

means responsive to said time varying compensation signal for compensating the measured frequency of the oscillator signal for the periodic fluctuation caused by the noise; and means for providing an output signal representative of whether presence of an object is detected based upon the measured frequency as compensated for the periodic fluctuation.

* * * * *